US006620090B2

(12) United States Patent
Fischer et al.

(10) Patent No.: US 6,620,090 B2
(45) Date of Patent: Sep. 16, 2003

(54) FREE-JET CENTRIFUGE FOR CLEANING LUBRICANT OIL WITH REDUCED RUN-ON TIMES

(75) Inventors: Helmuth Fischer, Remseck (DE); Peter Frehland, Ditzingen (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/045,030

(22) Filed: Jan. 15, 2002

(65) Prior Publication Data

US 2002/0107132 A1 Aug. 8, 2002

Related U.S. Application Data

(63) Continuation of application No. PCT/EP00/05598, filed on Jun. 17, 2000.

(30) Foreign Application Priority Data

Jul. 15, 1999 (DE) ..... 199 33 040

(51) Int. Cl.[7] ..... B04B 9/06

(52) U.S. Cl. ..... 494/49; 494/83; 494/84

(58) Field of Search ..... 494/24, 36, 43, 494/49, 64, 65, 67, 83, 84, 901; 210/168, 171, 232, 360.1, 380.1, 416.5; 184/6.24

(56) References Cited

U.S. PATENT DOCUMENTS 4,106,689 A * 8/1978 Kozulla
4,165,032 A * 8/1979 Klingenberg
4,284,504 A * 8/1981 Alexander et al.
4,346,009 A * 8/1982 Alexander et al.
6,095,964 A * 8/2000 Purvey
6,354,987 B1 * 3/2002 Frehland et al.
6,424,067 B1 * 7/2002 Samways

FOREIGN PATENT DOCUMENTS

| | | | |
|---|---|---|---|
| DE | 1918531 | * 12/1969 | |
| DE | 2314369 | * 10/1974 | |
| FR | 1070737 | * 8/1954 | |
| GB | 581622 | * 11/1948 | |
| GB | 668766 | * 3/1952 | ..... 494/49 |
| GB | 2322315 | * 8/1998 | |
| SU | 1017390 | * 5/1983 | ..... 494/49 |
| SU | 1639765 | * 4/1991 | |
| WO | 92/11946 | * 7/1992 | |

* cited by examiner

*Primary Examiner*—Charles E. Cooley
(74) *Attorney, Agent, or Firm*—Crowell & Moring LLP

(57) ABSTRACT

A free-jet centrifuge which, in contrast to prior art centrifuges which are braked by bearing friction, includes a device for braking the rotor when the oil pressure falls below a predetermined value. The rotor is mounted in a slide bearing (12), which simultaneously forms the centrifuge oil inlet (23), and also is provided with a roller bearing (19), which minimize bearing friction and enables the rotor to attain the highest possible rotational speeds. Friction partners **(15*a*, 15*b*) are disposed on the centrifuge housing (10) and rotor (11) and are pressed against one another by a spring (20)** when the oil pressure drops below operating pressure, to stop the rotor in order to minimize run-on of the centrifuge and the noise and bearing wear associated with run-on.

12 Claims, 2 Drawing Sheets

FREE-JET CENTRIFUGE FOR CLEANING LUBRICANT OIL WITH REDUCED RUN-ON TIMES

CROSS REFERENCE TO RELATED APPLICATIONS

This application is a continuation of international patent application no. PCT/EP00/05598, filed Jun. 17, 2000, designating the United States of America, the entire disclosure of which is incorporated herein by reference. Priority is claimed based on Federal Republic of Germany patent application no. DE 199 33 040.9, filed Jul. 15, 1999.

BACKGROUND OF THE INVENTION

The invention relates to a free-jet centrifuge suitable, for instance, for cleaning the lubricating oil in an internal combustion engine.

Freejet centrifuges of this type are known in the art. German Utility Model application no. DE 296 09 980 U1 proposes a rotor of a centrifuge suitable for mass production in large numbers. It comprises a plurality of sheet metal cups that are connected by common flanging (see FIG. 1 of the cited document). This unit has a center tube 30 into which sleeves 31, 32 are inserted. These sleeves rotatably support the centrifuge rotor on a housing shaft 16 and limit the axial play of the rotor within the clearance. During operation, the rotor can move back and forth between the axial limits of the housing. Due to the oil pressure and any downward tilt of the nozzles 28, the rotor tends to rise inside the housing.

If the oil pressure drops below a predetermined value, valve 40 closes, thus preventing the oil from passing through the centrifuge rotor. Due to bearing friction of the slide bearings, the rotor then comes to a stop. Bearing friction is increased because the centrifuge rotor is lowered to the lower axial limit stop within the housing, which increases the bearing surface of the slide bearing.

Despite the use of integrated components, e.g., pressure valve 40, the described rotor module is highly complex. This makes it difficult to produce the rotor in an economical manner. In particular, the axial position of the rotor is not precisely defined during operation. Sudden pressure fluctuations can, for instance, cause the rotor to strike against one of the axial limit stops even during operation. As a consequence, these limit stops must be equipped with similarly favorable frictional properties as the radial area of the slide bearings.

A further problem is the run-on behavior of the centrifuge when the oil supply is interrupted. In such a case, the centrifuge should come to a stop as quickly as possible. The kinetic energy of the rotor is reduced through bearing friction. To obtain the highest possible rotational speeds, however, bearing friction should be as low as possible. In other words, the more successful the reduction of bearing friction, the longer the centrifuge will run on.

If oil centrifuges are used in passenger cars, the requirements for smooth running characteristics of the engine are particularly high. At the same time, frequent load variations, e.g., if the car is used in densely populated areas, cause the centrifuge to be continuously turned on and off. When the internal combustion engine is idling, long run-on of the centrifuge rotor is unacceptable due to noise, since it is louder than the quiet engine noise in this operating state and is perceived as disagreeable by the driver.

SUMMARY OF THE INVENTION

The object of the invention is to provide an improved centrifuge with a rotor that achieves a good centrifuge result by realizing high rotational speeds A further object of the invention is to provide a centrifuge with a rotor which has short run-on times after being turned off.

These and other objects have been achieved in accordance with the present invention by providing a free-jet centrifuge comprising a rotor having an oil inlet, at least one drive nozzle as an outlet, and a deposition surface interiorly of the rotor; a housing in which the rotor is rotatably disposed to shield the rotor against the environment, and bearing means for rotatably supporting and limiting the axial play of the rotor inside the housing; in which a fixed, externally actuated power source is provided on the free-jet centrifuge, the power source exerting a force which acts on the rotor in an axial direction counter to axial forces created by rotor operation, the power source being dimensioned such that the centrifuge can be pushed against the axial play limit by actuation of the power source to brake the centrifuge from any operating state.

In accordance with a further aspect of the invention, the objects are achieved by providing a rotor for use with a free-jet centrifuge comprising a housing in which the rotor is rotatably mounted to shield it from the environment, the rotor comprising an oil inlet, at least one drive nozzle as an outlet, a deposition surface interiorly of the rotor, and rotor bearing means for engagement with mating housing bearing means to rotatably mount the rotor in the housing; wherein the rotor bearing means interacts with the housing bearing means to limit axial play of the rotor within the housing; and the rotor comprises a rotor friction surface outside the rotor bearing means for engagement with a housing friction surface to brake the rotor upon actuation of a power source.

The free-jet centrifuge according to the invention comprises a rotor with an inlet and at least one drive nozzle, which simultaneously serves as the outlet. The deposition surface for the separated suspended solids contained in the fluid is formed, for instance, by the rotor shell. The housing shields the rotor against the environment. This is necessary because the spray of the drive nozzles must be collected. Within the scope of the invention the term "housing" should be understood to refer to any type of casing protecting the environment. It is not necessary to provide a separate housing for the centrifuge. It is also feasible, for instance, to build the centrifuge into cavities of an internal combustion engine that forms part of the oil circuit. The support of the centrifuge rotor inside the housing simultaneously allows its rotation and limits its axial play.

According to the invention the free-jet centrifuge is provided with a power source, which is fixed inside the centrifuge housing and the force of which acts on the rotor. This power source can, for instance, be a prestressed helical spring, the ends of which are supported on the rotor bearing and on the housing, respectively. The force of the power source acts against the axial forces created during rotor operation. As a result, an equilibrium of forces is established between the power source and the rotor in operation. The rotor, within its axial range of movement, migrates into the position of this equilibrium of forces without contacting either of the axial limit stops. This permits low-friction operation of the centrifuge at high rotational speeds. The power source simultaneously acts as a buffer when there are pressure fluctuations that shift this equilibrium of forces, but it does not cause the rotor to rub against one of the axial limit stops.

As soon as the oil pressure falls below a certain value, the power source pushes the rotor against one of the axial limit strops. This creates a braking torque, which is capable of braking the rotor until it comes to a stop. Prolonged run-on is prevented, so that there are no audible running noises of the centrifuge, e.g., when the internal combustion engine is idling. The power source further has the positive effect that the bearing partners are kept under tension. As the centrifuge continues to rotate, this prevents knocking of the bearings due to the bearing play, which can also cause a disagreeable noise. Furthermore, the risk of bearing damage due to knocking, which shortens the life of the bearings, is avoided. This is necessary particularly if roller bearings are used to support the rotor. But slide bearings also benefit from the decreased run-on times. Due to the low oil pressure in this operating state, lubrication of the bearings is no longer fully assured. Prolonged run-on would therefore cause increased bearing wear.

Normally, the external support by the power source will act in the direction of the gravitational force. This has to do with the typical installation position of oil centrifuges. In prior art centrifuges, the force of gravity is the necessary counter force for the axial forces created in rotor operation. The use of the described power source, however, eliminates the need for a vertical installation position utilizing the gravitational force of the rotor. It can be completely replaced by the power source, so that it is possible, for instance, to install the rotor with a horizontal axis of rotation. This provides greater freedom of design when using a free-jet centrifuge, e.g., in an internal combustion engine.

If a spring is used as a power source as described, the spring exerts a force which depends on the axial position of the rotor within the housing in accordance with the characteristic curve of the spring. This is a particularly simple embodiment, which creates a self-regulating system for the free-jet centrifuge. A prerequisite, however, is that the spring is configured in such a way that the amount of the spring force is always less than or equal to the amount of the axial force created by rotor operation within the intended operating range. The operating range is defined by the rotational speed of the rotor and the oil pressure. Only below this operating range does the spring force exceed the axial force of the rotor, so that the rotor is pushed against one of its axial limit stops and is braked. When the oil pressure increases, the acceleration behavior of the rotor is ensured because the rotor can disengage again from the axial limit stop and be set into rotation. It then moves axially against the spring force until the described force equilibrium is reestablished. This self-regulating configuration can of course also be achieved with other power sources, e.g., a pneumatic cylinder.

Another advantageous option is to provide the power source with external actuation. This makes it possible to use any control mechanism to control the force applied by the power source. The power source can, for instance, comprise an externally controlled hydraulic cylinder. As an alternative, an electromechanical drive, e.g., a motor-gear combination may be used. The pressure capsules frequently used in the automotive field are also a feasible solution for the externally actuated drive of the power source.

With the aid of external actuation, the centrifuge can be braked from any operating state by being pushed against the axial limit stop when the power source is activated. Operating states in which braking of the rotor is appropriate are the previously described idling state as well as any impending insufficient lubricating oil supply of the internal combustion engine. In such a case, the externally actuated power source can turn off the centrifuge, so that the bypass flow of oil necessary to operate the centrifuge is available directly for lubrication. This function is normally assured through appropriate valves in the oil circuit, which can be omitted in the present invention. This provides additional savings that increase the economic efficiency of the invention or compensate the additional costs for the externally actuated power source.

A particularly advantageous embodiment is obtained if the free-jet centrifuge is equipped on one side with a slide bearing or plain friction bearing, which simultaneously acts as an inlet. In this case, the inflowing liquid provides lubrication. The second bearing used is a roller bearing, which has extremely low friction losses. The roller bearing is mounted completely outside the liquid stream to be centrifuged. The power source is clamped between a support inside the housing and the roller bearing, so that the roller bearing is axially displaceable. As the roller bearing is displaced, the centrifuge rotor is simultaneously moved. The slide bearing permits this axial movement. The roller bearing can, for instance, be fixed to the rotor with its inner race, whereas the power source engages with the outer race. This prevents any roller bearing play irrespective of the operating state of the centrifuge.

An alternative means for braking the rotor is to utilize a thrust reversal. This is accomplished by actuating nozzles on the centrifuge rotor, which enable a drive in the opposite direction of the normal direction of rotation. To this end, the nozzle heads of the centrifuge rotor may be rotatable, so that the thrust reversal is achieved by rotating the nozzles 180°. Another option is to mount additional braking nozzles, which spray in opposite direction of the drive nozzles. The pressure inside the rotor can be used to control the nozzles.

Another alternative embodiment of the invention provides for a friction surface pair outside the bearing means. One of the friction partners is fixed inside the housing and the other on the rotor. This friction surface pair can be used as a brake. It is advantageous to make the friction partners ring-shaped and to accommodate them in the area of one of the rotor axial end surfaces and the housing. The function of this friction surface pair is comparable to the above-described axial limit stop of the bearing. The friction surface pair replaces precisely this axial limit stop in the bearing, namely the one in the direction opposite the rotor's tendency of axial movement in operation. Outside the intended operating range of the rotor, the rotor is lowered onto the friction pairing and is thereby braked. This process can be supported by a power source in accordance with the invention. Alternatively, this effect can also be achieved solely by the gravitational force acting on the centrifuge rotor.

Decoupling the braking function and the bearing function makes it possible to select the ideal material pairs for the two tasks. Attention can be focused on minimizing friction losses in the design of the bearing and on maximizing the braking torque in the selection of the friction pairing for braking. Furthermore, the friction partners can be installed near the outer periphery of the rotor to further enhance the friction torque through their geometric arrangement. The following materials are particularly suitable for friction pairing to brake the rotor. The material of the one friction partner may advantageously be polyamide (PA), optionally reinforced with glass-fibers, polyoxymethylene (POM), or polytetrafluoroethylene (PTFE). The material for the other friction partner may advantageously be PA, POM or PTFE, or bronze, steel or an aluminum alloy.

In another advantageous embodiment of the invention, a brake band is arranged inside the housing. This brake band can, for example, interact with the lateral surface of the rotor. The desired braking effect can be achieved by tightening the brake band.

Providing the described means for braking the rotor, be it additional friction pairs or power sources to increase the friction in the bearings, makes it possible to brake the rotor to a full stop from any operating state. This makes it possible to minimize the flow through the centrifuge, since the volumetric flow rate at the nozzles reaches appreciable values only at high rotational speeds due to the dynamic pressures created in the interior of the centrifuge. At zero speed the volumetric flow rate through the narrow nozzle bore is negligible. This completely eliminates the need for valves to actuate and control the centrifuge. The leakage flow through the nozzle opening at zero-speed of the rotor is acceptable. Eliminating the control valves clearly increases the economic efficiency of the centrifuge.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
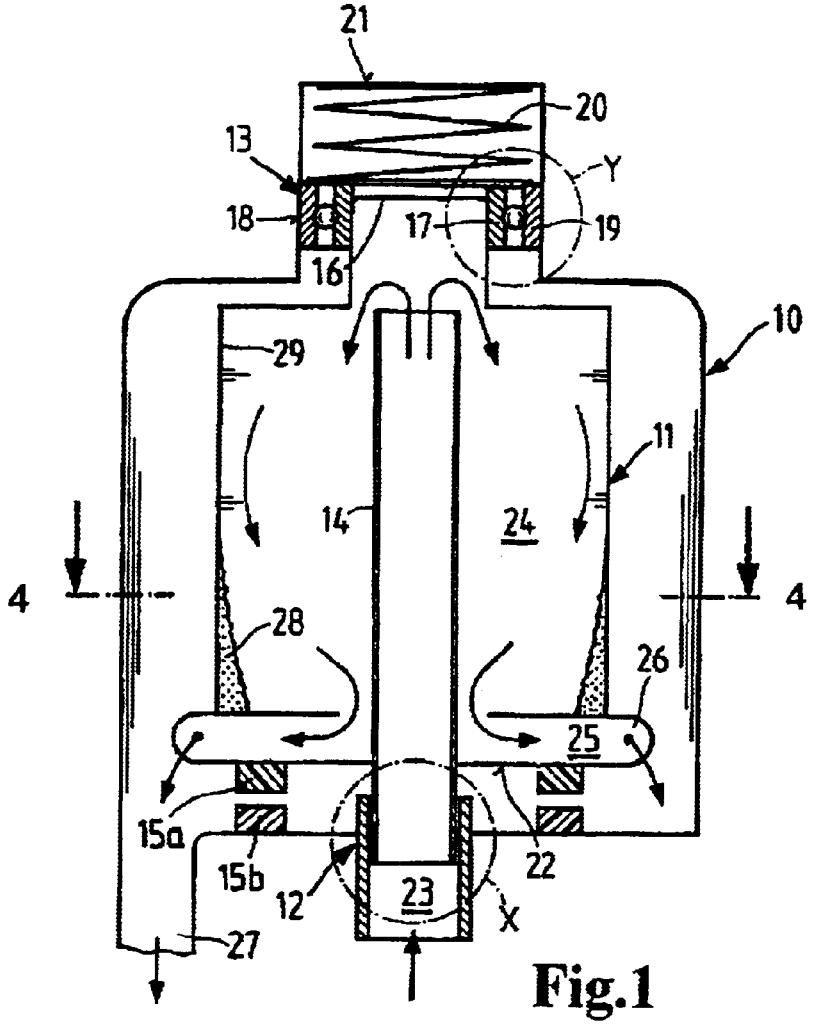
FIG. 1 is a cross section through a free-jet centrifuge according to the invention having a housing and rotor.

A free-jet centrifuge according to FIG. 1 comprises a housing 10 in which a rotor 11 is rotatably supported by means of a slide bearing 12 and a roller bearing 13. The slide bearing 12 allows for an axial displacement of the rotor, which extends into this bearing with a center tube 14. Friction surfaces 15*a*, 15*b* ensure axial limitation in the direction of the slide bearing.

The roller bearing 13 is fixedly connected with a connecting piece or stub shaft 16 on the rotor of the centrifuge. This connecting piece extends into an inner race 17 of the roller bearing. The outer race 19 of the roller bearing is radially fixed in the housing in a recess 18. The roller bearing 13 can be shifted in axial direction, but this displacement is limited by a helical spring 20 acting on the outer race 19 of the roller bearing. The spring has an abutment in a support 21 inside the housing.

At zero speed, spring 20 pushes the rotor 11 with friction surface 15*a*, which is mounted on an axial end surface 22 of the rotor, against friction surface 15*b*, which is accommodated in the housing. If the oil pressure increases in an inlet 23, the rotor acts like a hydraulic cylinder and rises inside the slide bearing 12 as soon as the force resulting from the oil pressure exceeds the force of the spring. The oil flows through the center tube 14 into a separating space 24, from there into nozzle ducts 25 and is sprayed through drive nozzles 26 into the housing, from where it is discharged through an outlet 27. The drive nozzles rotate rotor 11 causing the suspended solids 28 contained in the oil to be deposited along the deposition surface 29 of the rotor.

Between the spring force of spring 20 and the axial forces acting on rotor 11 an equilibrium is established as a function of the axial position of the rotor. Within the operating range, this axial position is above the axial limit stop formed by the friction surfaces 15*a* and 15*b*. The axial force on the rotor is determined primarily by the oil pressure at the inlet 23. If the oil pressure drops below a certain value, which defines the lower limit of the operating range, the spring force of spring 20 causes the rotor to be lowered. As a result, the friction surfaces 15*a*, 15*b* make contact, and the rotor is braked to a full stop.

Figure 2:
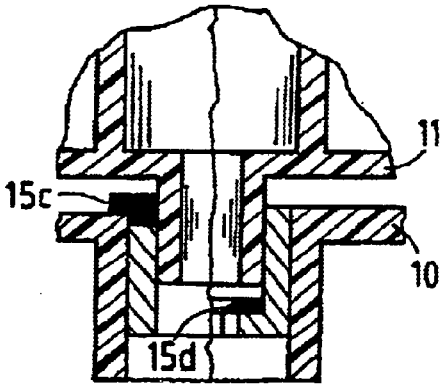
FIG. 2 is a detail view X from FIG. 1.

FIG. 2 shows an alternative arrangement of friction surface pairs. The friction surface pair does not necessarily need to be made of materials that are mounted to the parts of the centrifuge specifically for this purpose. It is also possible to use the material of housing 10 and rotor 11 itself. Furthermore, friction surfaces 15*c*, 15*d* can be accommodated in the area of the slide bearing. They form the axial limit stop as described. The friction surfaces cause an abrupt friction increase in the bearing as soon as the axial limit stop in the rotor makes contact with the friction surfaces.

Figure 3:
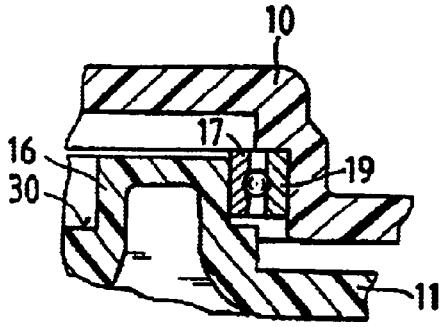
FIG. 3 is a detail view Y from FIG. 1.

FIG. 3 shows a variant of the roller bearing arrangement of the rotor without an additional power source. The roller bearing 19 is fixedly mounted inside housing 10. The connecting piece 16 of the rotor 11 is axially displaceable in the inner race 17 of the roller bearing. A shoulder 30 limits the axial movement. Analogous to the principle with power source, the gravitational force on rotor 11 acts as a reset force, which is in equilibrium with the axial forces acting on the rotor as described.

Figure 4:
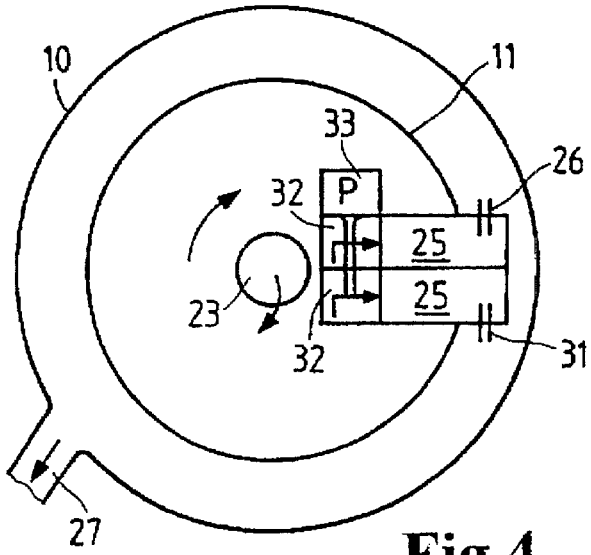
FIG. 4 is a schematic cross section through a centrifuge taken along line 4—4 of FIG. 1 showing an additional braking nozzle disposed along the circumference.

FIG. 4 depicts a centrifuge comprising a rotor 11 and a housing 10. Also shown are an inlet 23 and an outlet 27. In addition to the drive nozzle 26, the rotor has a braking nozzle 31. The nozzle ducts 25 are equipped with valves 32, which are provided with a pressure actuating element 33. This pressure actuating element switches the valves in such a way that the braking nozzle 31 is activated below the operating pressure range and the drive nozzle 26 is activated within the operating pressure range. If the pressure decreases to below the operating pressure, e.g., when the engine is idling, a switchover of the valves causes the braking nozzle to be activated. Although the pressure has already markedly dropped at inlet 23, the dynamic pressure, due to the high rotational speed in nozzle outlet 31, causes a strong impulse that applies a braking torque to the rotor. As a result, the rotor is braked. An arrow indicates the rotational direction of the centrifuge.

Figure 5:
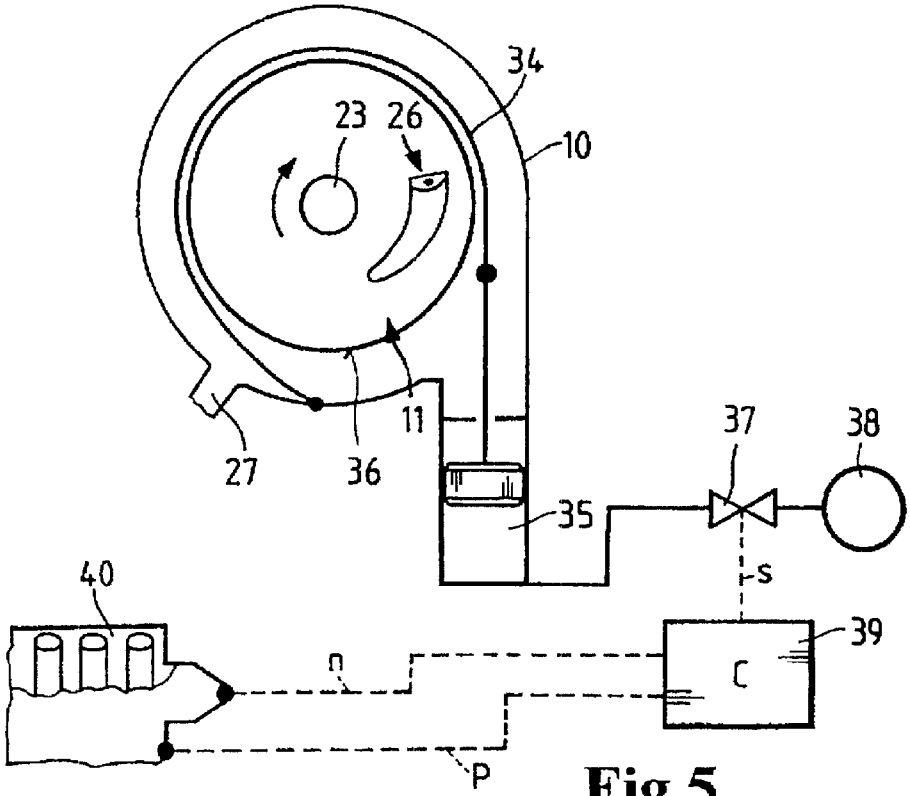
FIG. 5 is a cross section through a centrifuge with a brake band that is externally actuated using various engine parameters.

FIG. 5 depicts a centrifuge as shown in FIG. 4. Instead of the braking nozzle 31, however, a brake band 34 is provided, which is externally actuated by a schematically indicated pneumatic cylinder 35, which can also be formed, for instance, by a vacuum control unit. When the pneumatic cylinder 35 is actuated, the brake band 34 is pressed against an outer wall 36 of the rotor. This creates a braking torque, which is a function of the pressure applied to the pneumatic cylinder. The pneumatic cylinder is controlled by an actuating valve 37, which communicates with a pressure accumulator 38. The actuating valve is switched by a control unit 39, which relays the switching signal s to actuating valve 37 as a function of the parameters of an engine 40, such as speed n and oil pressure p. This arrangement allows the centrifuge to be brought to a full stop from any operating state. The drive nozzle 26 of the stopped centrifuge acts as a throttle, so that a valve to supply the centrifuge with oil is unnecessary.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A free-jet centrifuge comprising:

a rotor having an oil inlet, at least one drive nozzle as an outlet, and a deposition surface interiorly of said rotor;

a housing in which said rotor is rotatably disposed to shield the rotor against the environment;

bearing means for rotatably supporting and limiting axial play of the rotor inside the housing;

a brake including a friction surface disposed on the housing and a friction surface disposed on the rotor, wherein the brake can be applied by engaging the friction surfaces to stop the rotor; and a power source being able to exert a force on the rotor to engage the friction surfaces of the brake in an axial direction counter to direction of axial forces created by rotor operation, said power source being sized such that the axial forces created by rotor operation overcome the force of the power source so that the axial forces created by rotor operation disengage the friction surfaces, and without the axial forces created by rotor operation the force of the power source engages the friction surfaces to stop the rotor.

2. A free-jet centrifuge according to claim 1, wherein said centrifuge is arranged in a lubricating oil circuit of an internal combustion engine for cleaning the engine lubricating oil.

3. A free-jet centrifuge according to claim 1, wherein said bearing means comprise a slide bearing which simultaneously forms the inlet of the rotor.

4. A free-jet centrifuge according to claim 3, wherein said bearing means further comprise a roller bearing axially displaceably mounted in a recess in the housing.

5. A free-jet centrifuge according to claim 4, wherein the power source is clamped between a support in the housing and the roller bearing.

6. A free-jet centrifuge according to claim 1, wherein the power source is a helical spring.

7. A free-jet centrifuge according to claim 1, wherein the friction surfaces are radially outside the bearing means.

8. A free-jet centrifuge according to claim 7, wherein the friction surfaces are annular surfaces, one of the friction surfaces being arranged on an axial end of the rotor, and the other of the friction surfaces being arranged on a housing surface which faces said axial end of the rotor.

9. A free-jet centrifuge according to claim 8, wherein the friction surfaces are arranged in such a way that they limit the axial movement of the rotor in the direction of the force exerted by said power source.

10. A rotor for use with a free-jet centrifuge comprising a housing in which said rotor is rotatably mounted to shield it from the environment, said rotor comprising an oil inlet, at least one drive nozzle as an outlet, a deposition surface interiorly of said rotor, and rotor bearing means for engagement with mating housing bearing means to rotatably mount said rotor in said housing; wherein said rotor bearing means interacts with said housing bearing means to limit axial play of the rotor within said housing; and said rotor comprises a rotor friction surface outside the rotor bearing means for engagement with a housing friction surface to brake the rotor upon actuation of a power source that is able to exert a force on the rotor to engage the friction surfaces in an axial direction counter to direction of axial forces created by rotor operation, said power source being sized such that the axial forces created by rotor operation overcome the force of the power source so that the axial forces created by rotor operation disengage the friction surfaces, and without the axial forces created by rotor operation the force of the power source engages the friction surfaces to stop the rotor.

11. A rotor according to claim 10, wherein the rotor friction surface is an annular surface arranged on an axial end of the rotor.

12. A method of operating a free-jet centrifuge that includes a rotor having an oil inlet, at least one drive nozzle as an outlet, and a deposition surface interiorly of said rotor; a housing in which said rotor is rotatably disposed to shield the rotor against the environment; and bearing means for rotatably supporting and limiting axial play of the rotor inside the housing; a brake including a friction surface disposed on the housing and a friction surface disposed on the rotor, wherein the brake can be applied by engaging the friction surfaces to stop the rotor; and a power source being able to exert a force on the rotor to apply the brake, the method comprising:

during operation of the centrifuge, allowing axial forces created by rotor operation to overcome the force of the power source so that the axial forces created by rotor operation disengage the friction surfaces to allow the rotor to rotate; and when the operation of the centrifuge stops, allowing the force of the power source to engage the friction surfaces to stop the rotor.

* * * * *